US007459574B2

(12) United States Patent
Richard-Elsner et al.

(10) Patent No.: US 7,459,574 B2
(45) Date of Patent: Dec. 2, 2008

(54) REDUCING THE ODOR OF OIL COMPONENTS BY MEANS OF ADSORPTION WITH POLYMERIC ADSORBING AGENTS

(75) Inventors: Christiane Richard-Elsner, Düsseldorf (DE); Wilhelm Johannisbauer, Erkrath (DE); Erich Reuter, Düsseldorf (DE); Albrecht Schwerin, Düsseldorf (DE)

(73) Assignee: Cognis IP Management GmbH, Duesseldorf (DE)

( * ) Notice: Subject to any disclaimer, the term of this patent is extended or adjusted under 35 U.S.C. 154(b) by 368 days.

(21) Appl. No.: 10/542,486

(22) PCT Filed: Dec. 19, 2003

(86) PCT No.: PCT/EP03/14597

§ 371 (c)(1), (2), (4) Date: Jul. 15, 2005

(87) PCT Pub. No.: WO2004/065532

PCT Pub. Date: Aug. 5, 2004

(65) Prior Publication Data

US 2006/0165737 A1 Jul. 27, 2006

(30) Foreign Application Priority Data

Jan. 22, 2003 (DE) ..... 103 02 299

(51) Int. Cl.
*C11B 3/10* (2006.01)

(52) U.S. Cl. ..... 554/191; 554/175

(58) Field of Classification Search ..... None
See application file for complete search history.

(56) References Cited

FOREIGN PATENT DOCUMENTS

| | | | | |
|---|---|---|---|---|
| DE | 27 31 520 | A1 | | 1/1979 |
| DE | 100 59 208 | A1 | | 6/2002 |
| EP | 0 108 571 | A2 | | 5/1984 |
| GB | 880412 | A | | 10/1961 |
| JP | 61257945 | | * | 11/1966 |
| JP | 58-020152 | A | | 2/1983 |
| JP | 61-257945 | A | | 11/1986 |
| JP | 06-007084 | A | | 1/1994 |
| JP | 08-302382 | A | | 11/1996 |
| JP | 08302382 | | * | 11/1996 |
| JP | 2001-49289 | A | | 2/2001 |
| WO | WO 98/43500 | A1 | | 10/1998 |

* cited by examiner

*Primary Examiner*—Deborah D Carr

(57) ABSTRACT

A process for reducing the odor of an oil. The oil being treated is first distilled by a carrier vapor or carrier gas distillation to form a distilled oil. The distilled oil is then contacted with a polymeric adsorbent; whereby the odor of the oil is reduced. The polymeric adsorbent is regenerated. The polymeric adsorbent can be a cross-linked polymer with an internal surface area of from 900 to 1500 $m^2$/gram.

12 Claims, No Drawings

REDUCING THE ODOR OF OIL COMPONENTS BY MEANS OF ADSORPTION WITH POLYMERIC ADSORBING AGENTS

RELATED APPLICATIONS

This application is filed under 35 U.S.C. § 371 claiming priority from Application PCT/EP2003/014597 filed on Dec. 19, 2003 which claims priority of German patent application DE 103 02 299.6 filed on Jan. 22, 2003, the entire contents of each application are incorporated herein by reference.

FIELD OF THE INVENTION

The present invention relates to a process for reducing odor in oil components which is characterized in that, in addition to deodorization by carrier vapor or carrier gas distillation, the oil components are purified by adsorption onto polymeric adsorbents.

BACKGROUND OF THE INVENTION

Oil components are widely used in the field of cosmetic and food products. In the production of oil components, however, various unwanted secondary products, often with unpleasant odors, are formed in addition to the target product. It is precisely in the sensitive cosmetic and food markets that the sensory properties of starting products are so important.

In order to eliminate these troublesome secondary products, i.e. the troublesome odor of the oil components, so-called deodorization is generally carried out, troublesome substances being separated off by carrier vapor or carrier gas distillation. In many cases, the oil components still have a characteristic odor even after this separation step.

The problem addressed by the present invention was to provide a process in which the odor of oil components would be distinctly improved by the use of easy-to-handle and regeneratable auxiliaries and the purified products would have a high degree of purity.

The use of conventional adsorbents, such as active carbon and bleaching earths, was not a solution because, in the purification of the oil components, adsorbents such as these soil the filter presses for example, so that impurities can be carried over.

However, the problem stated above can be solved by not only deodorizing the oil components, but also purifying them using polymeric adsorbents. Oil components can be purified with particular effect using polymeric adsorbents having an inner surface of 900 to 1500 $m^2/g$.

BRIEF DESCRIPTION OF THE INVENTION

Accordingly, the present invention relates to a process for reducing odor in oil components which is characterized in that, in addition to deodorization by carrier vapor or carrier gas distillation, the oil components are purified by adsorption onto polymeric adsorbents.

In the same way as before, the oil components are freed from secondary components in a first purification step comprising carrier vapor distillation or carrier gas distillation. This is followed by adsorption with a suitable polymeric adsorbent.

DETAILED DESCRIPTION OF THE INVENTION

Oil Components

Oil components in the context of the invention are the following compounds:

- Guerbet alcohols based on fatty alcohols containing 6 to 18 and preferably 8 to 10 carbon atoms,
- esters of linear $C_{6-22}$ fatty acids with linear or branched $C_{6-22}$ fatty alcohols or
- esters of branched $C_{6-13}$ carboxylic acids with linear or branched $C_{6-22}$ fatty alcohols such as, for example, myristyl myristate, myristyl palmitate, myristyl stearate, myristyl isostearate, myristyl oleate, myristyl behenate, myristyl erucate, cetyl myristate, cetyl palmitate, cetyl stearate, cetyl isostearate, cetyl oleate, cetyl behenate, cetyl erucate, stearyl myristate, stearyl palmitate, stearyl stearate, stearyl isostearate, stearyl oleate, stearyl behenate, stearyl erucate, isostearyl myristate, isostearyl palmitate, isostearyl stearate, isostearyl isostearate, isostearyl oleate, isostearyl behenate, isostearyl oleate, oleyl myristate, oleyl palmitate, oleyl stearate, oleyl isostearate, oleyl oleate, oleyl behenate, oleyl erucate, behenyl myristate, behenyl palmitate, behenyl stearate, behenyl isostearate, behenyl oleate, behenyl behenate, behenyl erucate, erucyl myristate, erucyl palmitate, erucyl stearate, erucyl isostearate, erucyl oleate, erucyl behenate and erucyl erucate,
- esters of linear $C_{6-22}$ fatty acids with branched alcohols, more particularly 2-ethyl hexanol,
- esters of $C_{18-38}$ alkylhydroxycarboxylic acids with linear or branched $C_{6-22}$ fatty alcohols, more especially Dioctyl Malate,
- triglycerides based on $C_{6-10}$ fatty acids,
- liquid mono-, di- and triglyceride mixtures based on $C_{6-18}$ fatty acids,
- esters of $C_{2-12}$ dicarboxylic acids with linear or branched alcohols containing 1 to 22 carbon atoms or polyols containing 2 to 10 carbon atoms and 2 to 6 hydroxyl groups,
- vegetable oils,
- linear and branched $C_{6-22}$ fatty alcohol carbonates, such as Dicaprylyl Carbonate (Cetiol® CC) for example,
- Guerbet carbonates based on $C_{6-18}$ and preferably $C_{8-10}$ fatty alcohols,
- linear or branched, symmetrical or nonsymmetrical dialkyl ethers containing 6 to 22 carbon atoms per alkyl group, such as Dicaprylyl Ether (Cetiol® OE).

However, oil components selected from the group consisting of 2-octyl dodecanol, palmitic acid/stearic acid-2-ethylhexyl ester, triglycerides with fatty acid chain lengths of 6 to 12 carbon atoms, di-n-octyl ether and glyceryl caprylate caprate cocoate are particularly suitable for purification by polymeric adsorbents.

Process

The adsorption step may be carried out as an agitation process, a fixed bed process or a fluidized bed process. In one particular embodiment, the adsorption onto polymeric adsorbents is carried out as a fixed bed process or an agitation process.

A preferred process is characterized in that the adsorption onto polymeric adsorbents is carried out at atmospheric pressure.

In a particularly preferred embodiment of the process, the adsorption onto polymeric adsorbents is carried out at temperatures in the range from 0 to 100° C., preferably at temperatures in the range from 20 to 90° C. and more particularly at temperatures in the range from 40 to 80° C.

In another particularly preferred embodiment, the adsorption onto polymeric adsorbents is carried out as a fixed bed process at temperatures in the range from 20 to 80° C. and at atmospheric pressure. Another preferred embodiment is characterized in that the adsorption onto polymeric adsorbents is carried out as an agitation process at temperatures of 20 to 80° C. and at atmospheric pressure.

Polymeric Adsorbents

According to the invention, ion exchanger resins, for example, may be used as the polymeric adsorbents. However, the use of polymeric adsorbents with an inner surface of 900 to 1,500 $m^2/g$ is particularly preferred. A particularly suitable adsorbent is Purolite® MN 100, of which the "made-to-measure" inner surface is comparable with that of an active carbon. In contrast to active carbon, the polymeric adsorbent can easily be removed from the purified product.

EXAMPLES

Example 1

Fixed Bed Process

Purification of an octanoic acid/decanoic acid triglyceride with a highly crosslinked polymeric adsorbent based on polystyrene in a fixed bed column. 65 g Purolite MN 100 (inner surface ca. 1,000 $m^2/g$), water-moist as supplied by the manufacturer, were first washed three times with water heated to 70° C. to remove production-related impurities and then dried at 60° C. in a drying cabinet.

An 80 cm tall double-walled glass column was filled with the adsorbent (ca. 110 ml). The adsorbent was held underneath by a frit and fixed at the top of the column by glass balls. The nonanoic/decanoic acid triglyceride mixture to be purified was introduced into a double-walled receiver heated to 50° C. The triglyceride mixture was introduced into the column of adsorbent from below at a rate of 5 bed volumes per hour (550 ml/h). A Sartorius diaphragm pump was used for this purpose. The temperature in the column was also 50° C.

Odor tests showed that, after passing through the column, the octanoic/decanoic acid triglyceride mixture had a far weaker odor than the non-purified substance.

Regeneration of the Adsorbent

The charged adsorbent was desorbed with acetone at room temperature. To this end, 3 bed volumes (BV) of acetone were introduced downwards into the column at a rate of 2 BV/h. The last bed volume of acetone was left in the column for one hour. Another two bed volumes were then introduced into the column at a rate of 2 BV/h. Thereafter only clear acetone left the column. The acetone was first displaced with water at room temperature. The column was then rinsed with water at 80° C. for several hours in order to flush out residues of acetone. The column could then be re-used for improving the odor of the nonanoic/decanoic acid triglyceride mixture.

Example 2

Agitation Process

Purification of octyl dodecanol with a highly crosslinked polymeric adsorbent based on polystyrene in a stirred container. Purolite MN 100 (inner surface ca. 1,000 $m^2/g$) was purified as in Example 1.

100 g octyl dodecanol were introduced into a 250 ml brown glass flask equipped with a propeller stirrer and heated with continuous stirring to 40° C. on a heating plate. 1 g Purolite MN 100 was then added. After 30 minutes, the stirrer was switched off and the mixture was filtered with a Sartorial 0.45 μm single spray filter. The filtered octyl dodecanol has a far weaker odor than the non-purified starting substance.

We claim:

1. A process for reducing odor of an oil component which comprises:

(a) distilling the oil component by carrier vapor or carrier gas distillation to form a distilled oil component; and (b) contacting the distilled oil component with a polymeric adsorbent at atmospheric pressure, which adsorbent is a cross-linked polymer with an internal surface area of 900 to 1,500 $m^2/g$, wherein the odor of the oil component is reduced.

2. The process as claimed in claim 1, wherein the oil component comprises at least one member selected from the group consisting of 2-octyl dodecanol, palmitic acid/stearic acid-2-ethyl hexyl ester, triglycerides with fatty acid chain lengths of 6 to 12 carbon atoms, di-n-octyl ether and glyceryl caprylate caprate cocoate.

3. The process as claimed in claim 1, wherein, the contacting of the distilled oil with the polymeric adsorbent is carried out by a process selected from the group consisting of fixed bed processes, mixing processes and combinations thereof.

4. The process as claimed in claim 1, wherein, the contacting with the polymeric adsorbent is carried out at a temperature in a range from 0° C. to 100° C.

5. The process as claimed in claim 1, wherein, the contacting with the polymeric adsorbent is carried out as a fixed bed process at a temperature in the range from 20° C. to 80° C.

6. The process as claimed in claim 1, wherein, the contacting with the polymeric adsorbent is carried out with agitation at a temperature in a range of 20° C. to 80° C.

7. The process of claim 1, wherein, the contacting with the polymeric adsorbent is carried out at a temperature in a range of 20° C. to 90° C.

8. The process of claim 1 wherein the contacting with the polymeric adsorbent is carried out at a temperature in a range of 40° C. to 80° C.

9. The process of claim 1 wherein the polymeric adsorbent comprises an ion exchange resin.

10. The process of claim 2, wherein, the contacting of the distilled oil component with the polymeric adsorbent is carried out by a process selected from the group consisting of fixed bed processes, mixing processes and combinations thereof.

11. The process of claim 3, wherein, the contacting with the polymeric adsorbent is carried out at a temperature in a range from 0° C. to 100° C.

12. The process of claim 1 wherein the polymeric adsorbent is regeneratable.

* * * * *